US009404442B2

(12) United States Patent
Laws

(10) Patent No.: US 9,404,442 B2
(45) Date of Patent: Aug. 2, 2016

(54) FUEL BOWL FOR CARBURETOR SYSTEM AND ASSOCIATED METHODS

(71) Applicant: TAJM LLC, Howey-in-the-Hills, FL (US)

(72) Inventor: James M. Laws, Howey-in-the-Hills, FL (US)

(73) Assignee: TAJM LLC, Howey-in-the-Hills, FL (US)

( * ) Notice: Subject to any disclaimer, the term of this patent is extended or adjusted under 35 U.S.C. 154(b) by 194 days.

(21) Appl. No.: 14/459,504

(22) Filed: Aug. 14, 2014

(65) Prior Publication Data

US 2016/0047336 A1 Feb. 18, 2016

(51) Int. Cl.
*F02M 7/08* (2006.01)
*F02M 5/12* (2006.01)

(52) U.S. Cl.
CPC .. *F02M 7/08* (2013.01); *F02M 5/14* (2013.01)

(58) Field of Classification Search
CPC ..... F02M 7/06; F02M 7/08
USPC ..... 261/34.1, 34.2, 72.1
See application file for complete search history.

(56) References Cited

U.S. PATENT DOCUMENTS 3,051,193 A * 8/1962 Griffen ..... F02M 1/00 137/450
4,737,319 A * 4/1988 Saxby ..... F02M 5/125 261/34.1

* cited by examiner

*Primary Examiner* — Robert A Hopkins
(74) *Attorney, Agent, or Firm* — Mark Malek; Kelly G. Swartz; Widerman Malek, PL

(57) ABSTRACT

A fuel bowl for a carburetor system may include a fuel container and a fuel flow assembly that is removeably couplable thereto. The fuel container may include a base, a pair of sidewalls extending upwardly from the base, a rear wall extending upwardly from the base, a top overlying the pair of sidewalls and the rear wall, and a cavity defined by the pair of sidewalls and the rear wall. The fuel flow assembly may include a base, a pair of sidewalls extending upwardly from the base, a rear wall extending upwardly from the base, and a top overlying the pair of sidewalls and the rear wall.

20 Claims, 5 Drawing Sheets

FUEL BOWL FOR CARBURETOR SYSTEM AND ASSOCIATED METHODS

FIELD OF THE INVENTION

The present invention relates to fuel bowls for carburetor systems and, more specifically, to modular fuel bowls for a carburetor, and associated methods.

BACKGROUND

Carburetors have been used in engines to blend air and fuel. The fuel bowl is a component of the carburetor that assists in delivering fuel to the carburetor. A fuel float regulates how much fuel may enter into the fuel bowl. Cars today, however, are becoming too powerful. With a more powerful engine, it is difficult to keep the fuel bowl full. Some current fuel bowls use a needle and seat assembly valve to allow fuel to enter the carburetor. The needle and seat assembly acts as a bottleneck for fuel flow, preventing continuous flow. Without the use of a valve, however, the engine may become flooded with fuel and, as such, inoperable.

Existing fuel bowls have different threading at the fuel inlets. Therefore, in typical existing designs, if a different thread is needed on the inlet, a completely new fuel bowl must be purchased and attached to the carburetor. The attachment process provides opportunities for misalignment and error which may result in decreased efficiency, or even failure, of the engine. Additionally, fuel inlet locations are limited on current fuel bowls, creating increased difficulties with regard to access.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a fuel bowl for a carburetor adapted to provide ease of access and further adapted to receive a plurality of fuel lines comprising different threading orientations.

These and other objects, features and objectives of the present invention are provided by a fuel bowl for a carburetor system that includes a fuel container and a fuel flow assembly that is removeably couplable to the fuel container. The fuel container may include a base, a pair of sidewalls extending upwardly from the base, a rear wall extending upwardly from the base, a top overlying the pair of sidewalls and the rear wall, and a cavity defined by the pair of sidewalls and the rear wall. The base may have a pair of pump housings formed therein. Each of the pair of pump housings may include at least one passageway formed therethrough to provide access to the cavity. The rear wall may include a fluid flow assembly passageway formed therethrough, and a plurality of carburetor fastener passageways formed therethrough.

The fuel flow assembly may include a base, a pair of sidewalls extending upwardly from the base, a rear wall extending upwardly from the base, and a top overlying the pair of sidewalls and the rear wall. A plurality of fuel inlet passageways may be formed in at least one of the sidewalls and the rear wall. A plurality of fuel flow assembly fastener passageways may be formed in the rear wall.

The plurality of fuel inlet passageways may include a first fuel inlet passageway formed in a first one of the pair of sidewalls, a second fuel inlet passageway formed in a second one of the pair of sidewalls, and a third fuel inlet passageway formed in the rear wall. The first, second and third fuel inlet passageways may be threaded. The threading of each of the first, second and third fuel inlet passageways may be oriented differently from one another.

Each of the plurality of fuel flow assembly fastener passageways formed in the rear wall of the fuel flow assembly may include a recess adapted to receive a gasket. The fuel flow fastener assembly passageway formed in the rear wall of the fuel container may include a gasket recess formed therein adapted to receive a gasket. Each of the plurality of carburetor fastener passageways formed in the rear wall of the fuel container may include a recess adapted to receive a gasket. The fuel flow assembly fastener passageways formed in the rear wall of the fuel flow assembly may be adapted to be aligned with the fuel flow assembly fastener passageways formed in the rear wall of the fuel container when the fuel flow assembly is connected to the fuel container A method aspect of the present invention is for connecting a fuel bowl to a carburetor. The method may include connecting the fuel container to the carburetor by passing carburetor fasteners through the carburetor fastener passageways formed in the rear wall of the fuel container to engage a portion of the carburetor to which the fuel container is to be connected. The method may also include connecting the fuel flow assembly to the fuel container by aligning the fuel flow assembly fastener passageways formed through the rear wall of the fuel container with the fuel flow assembly fastener passageways formed through the rear wall of the fuel flow assembly. The method may further include passing a fuel flow assembly fastener through each of the fuel flow assembly fastener passageways formed in the rear wall of the fuel flow assembly through the rear wall of the fuel container.

DETAILED DESCRIPTION OF THE INVENTION

Figure 1A:
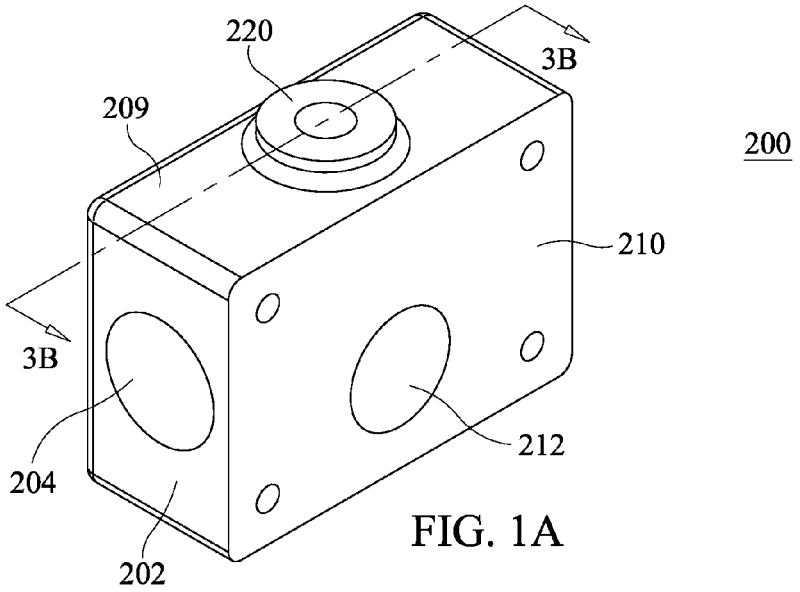
FIG. 1*a* is a perspective view an exemplary fuel container of a fuel bowl according to an exemplary embodiment of the present invention.

Exemplary embodiments of the present invention will now be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified. Further, throughout this disclosure the terms "passageways" and "holes" may be interchangeably used.

Referring now to the drawings, and more particularly to FIGS. 1*a*-5, there are shown exemplary embodiments of the method and structures according to the present invention.

Figure 1B:
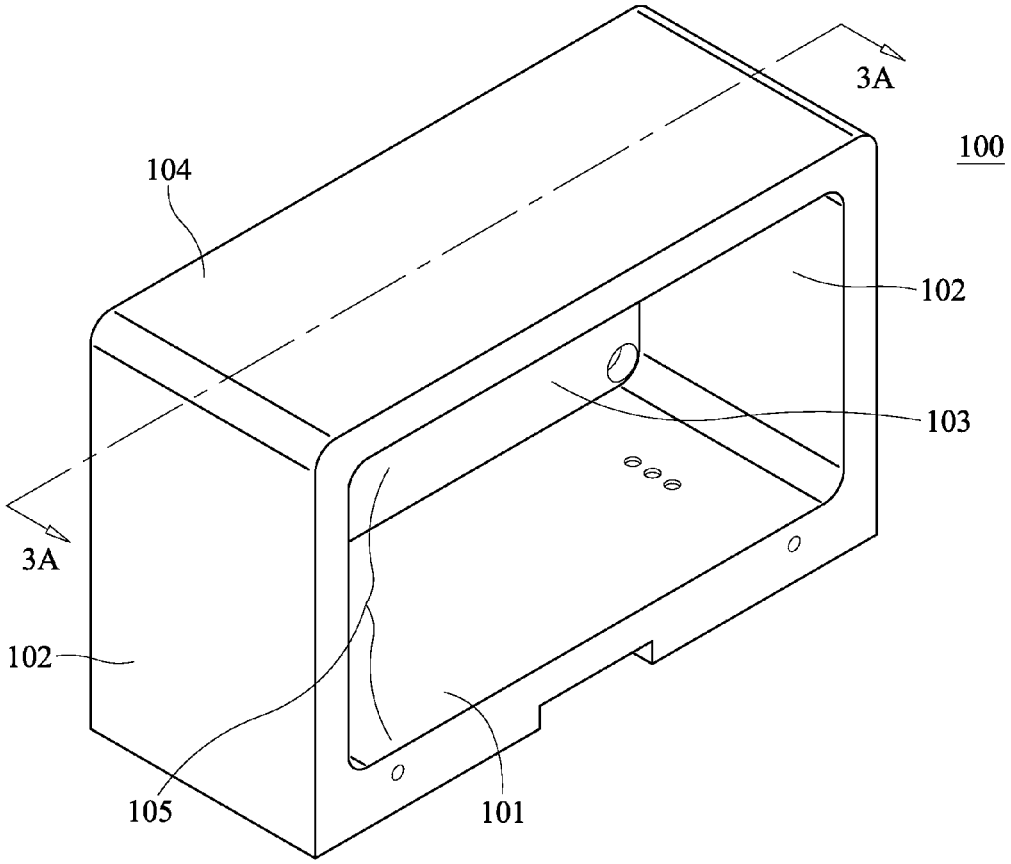
FIG. 1*b* is a perspective view exemplary fuel flow assembly of a fuel bowl according to an exemplary embodiment of the present invention.
Figure 2A:
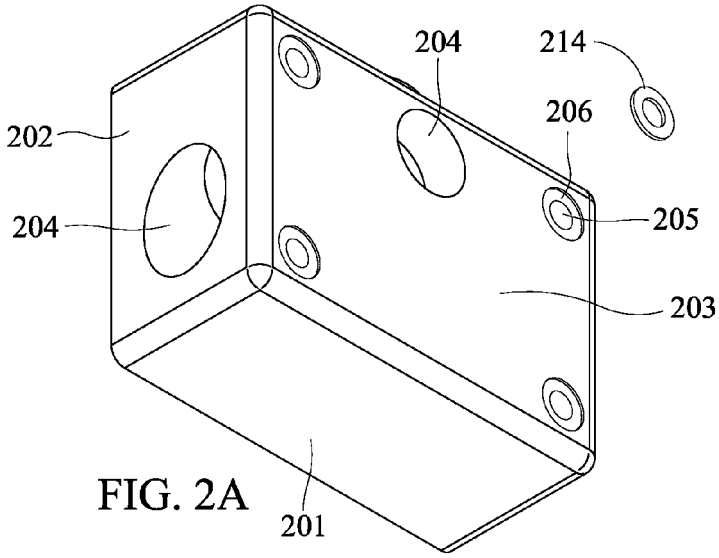
FIG. 2*a* is a side perspective view of an exemplary embodiment of the fuel container illustrated in FIG. 1*a*.
Figure 2B:
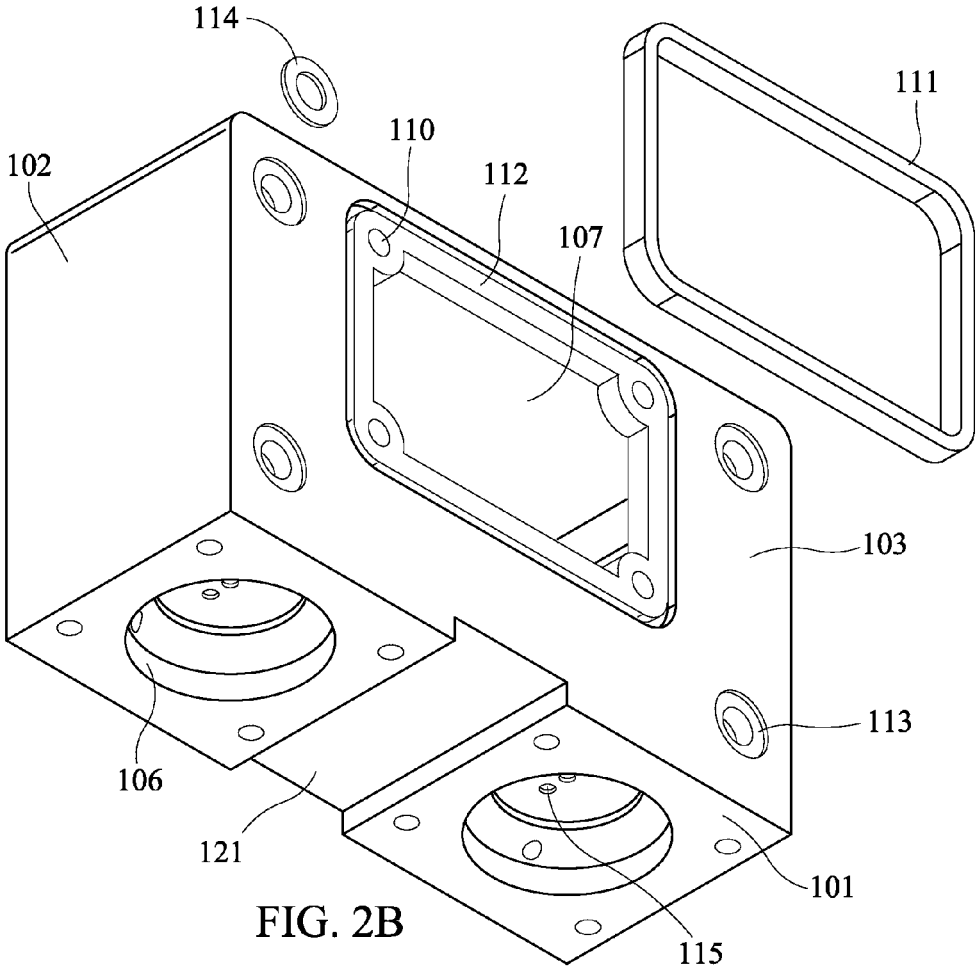
FIG. 2*b* is a side perspective view of an exemplary embodiment of the fuel flow assembly illustrated in FIG. 1*b*.

As illustrated, for example, in FIG. 1, an exemplary embodiment of the fuel bowl system for a carburetor includes a fuel container 100 and a fuel flow assembly 200. The fuel container 100 is configured to attach to a carburetor main body 500 and the fuel flow assembly 200 is configured to attach to the fuel container 100. In this manner, the fuel flow assembly 200 can be removed without the need to disconnect the fuel container 100 from the carburetor main body. This is advantageous because it allows the inside of the carburetor to be accessed more easily without having to line up the gaskets with the accelerator pump actuator, and so can reduce misalignment and assembly errors.

In an exemplary embodiment, the fuel flow container 100 includes a base 101, a pair of sidewalls 102 extending upwardly from the base 101 and a rear wall 103 also extending upwardly from the base. The sidewalls 102 may, for example, and without limitation, be opposing sidewalls, but the skilled artisan will appreciate that the sidewalls may extend upwardly from the base 101 in any configuration while still accomplishing the goals, features and objectives according to the present invention. A top wall 104 may overlay the pair of sidewalls 102 and the rear wall 103. The rear wall 103 and sidewalls 102 define a cavity 105 in which fuel can be held. As perhaps best illustrated in FIG. 2*a*, the rear wall 103 may include an opening 107 configured to be in fluid communication with the fuel flow assembly 200.

While an embodiment of the fuel container 100 has been described as a parallelogram, in other embodiments, the housing of the fuel flow container 100 can have curved sidewalls or a hemispherical shape. In such an embodiment, opening 107 can be formed in an appropriate location and the side, front, and rear walls, and base, can be omitted or incorporated therein accordingly.

The opening 107 can include a perimeter to accept a gasket 111 and can include attachment locations, such as holes or through-holes 110 (also referred to as passageways) to accept bolts, so as to allow attachment of fuel flow assembly 200 thereto. In addition, the fuel container 100 can include an attachment portion for connecting to the main body 500 of the carburetor. The attachment portion can include holes 110 and a portion or recess 112 configured to hold a gasket 111. In an embodiment, holes 110 may be provided through which bolts 800 can be inserted to connect the fuel container 100 to the carburetor main body. The holes 110 can include a recess 113 formed so as to accommodate a gasket 114 (e.g., an O-ring, gasket paste, etc.).

The base 101 may include one or more pump housings 106. In the embodiment shown in FIG. 2*a*, the base 101 includes two pump housings 106 formed therein. The pump housings 106 include at least one passageway 115 formed therethrough so as to provide access to the cavity 105. This embodiment, for example, allows the use of two accelerator pumps 400 to drive the carburetor. An accelerator pump allows an extra injection of fuel when the carburetor is first opened (i.e., the pump delivers a shot of fuel when needed). If fewer accelerator pumps are needed or present than the number of pump housings 106 included in the design, then the extra pump housings 106 can be blocked off (e.g., with a cap or plug). The fuel container 100 may also include a groove 121 running a length of the base 101 between the pump housings 106.

The fuel container 100 may include a valve system 600. In exemplary embodiments, the valve system may be a needle and seat assembly to regulate fuel flow into the engine. Exemplary needle and seat assemblies are discussed in U.S. Pat. Nos. 4,702,215 and 5,984,281, the entire contents of each of which are incorporated herein by reference. The needle and seat assembly used for this application may be a larger version of conventional valves. The valve system 600 may be attached at a valve system receiver 220 on fuel flow assembly 200. In some embodiments, the valve system receiver 220 may be disposed in a wall of fuel assembly 200 on which a fuel inlet port 204 is not formed. In some embodiments, the valve system receiver 220 may be formed in the top 209.

In exemplary embodiments of the present invention, the fuel container 100 is configured to accept fuel jets 400 (e.g., two fuel jets). By having a removable fuel assembly 200, it allows the two fuel jets to be accessed by simply removing the fuel assembly 200 without having to remove the fuel container 100. This allows the inside of the carburetor to be accessed more easily without having to line up the gaskets with the accelerator pump actuator, and so can reduce misalignment and assembly errors.

In addition, exemplary embodiments may have the length L (or depth) of the fuel container 100 increased or decreased in order to optimize volume versus the slosh of the fuel and to accommodate variously sized and/or shaped fuel floats.

The fuel flow assembly 200 is configured so as to be connected to the fuel container 100 at opening 107 using bolts 300. In an exemplary embodiment, the fuel flow assembly 200 can include a base 201, a pair of sidewalls 202 extending upwardly from the base 201, a rear wall 203 extending upwardly from base 201, and a top 209 overlaying the pair of sidewalls 202 and the rear wall 203. A fuel inlet passageway 204 is formed in the body of the fuel flow assembly 200. In the exemplary embodiment shown in FIG. 2A, fuel inlet passageways 204 are formed in the side walls 202 and the rear wall 203. Each wall can obtain any number of fuel inlets 204, or no fuel inlet.

Additionally, the fuel flow assembly 200 can include a fastening portion for connecting the fuel flow assembly 200 to the fuel container 100. The type of fastener, and the number thereof, are not particularly limited. In the embodiment shown in FIG. 2A, a plurality of fastener passageways 205 are formed in the rear wall 203 for accepting a fastening device such as a bolt 300. As illustrated in the exemplary embodiment, the fastener passageways 205 are formed so as to be aligned with holes 110 when the fuel flow assembly 200 is in a mounting position. Fastener passageways 205 can be configured with a recess 206 in which to fit a gasket 214.

The fuel flow assembly 200 normally includes at least one fuel inlet port 204. In the exemplary embodiment shown in FIG. 1, the fuel flow assembly 200 includes four fuel inlet ports 204, however the number of inlet ports 204 is not particularly limited. The fuel inlet ports 204 can have an appropriate attachment for connecting fuel inlet lines 700. In an exemplary embodiment, the fuel inlet ports 204 can be threaded. In some embodiments, the fuel inlet ports 204 can have different thread configurations, or other appropriate connection configuration(s) (e.g., type, size, etc.), to allow different (or multiple) fuel line 700 connectors/sizes to be used. This can allow multiple locations in which a fuel line 700 can be installed so that installation can be simplified. Also, the ability to have different kinds of attachments for fuel inlet ports 204 means that you do not have to have separate fuel flow assemblies for different attachment schemes. This can simplify inventory and increases the efficiency of working on the system.

Figure 3A:
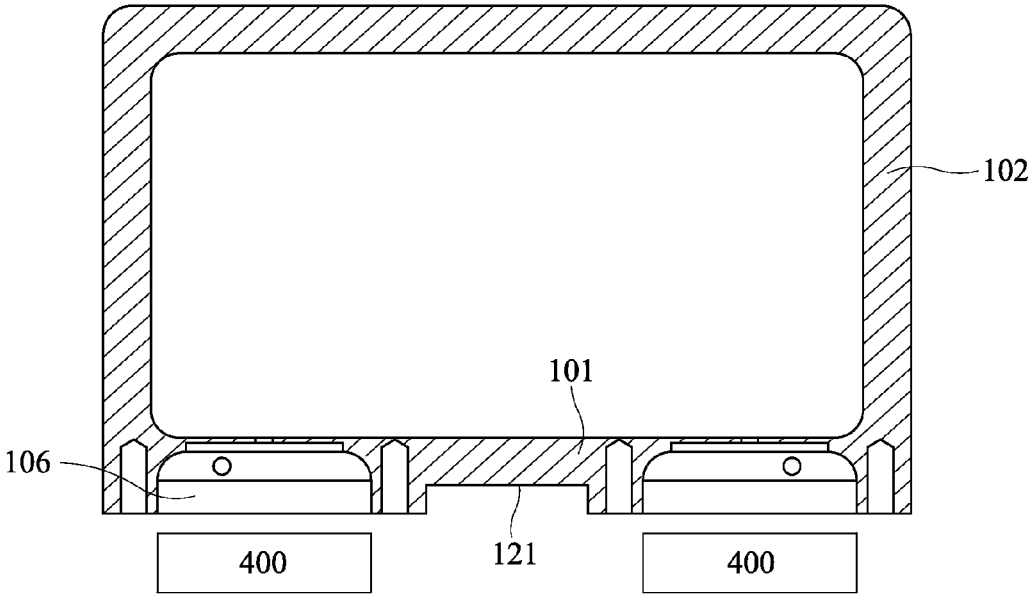
FIG. 3*a* illustrates a sectional view of the fuel container taken through lines 3*b*-3*b* in FIG. 1*a*.
Figure 3B:
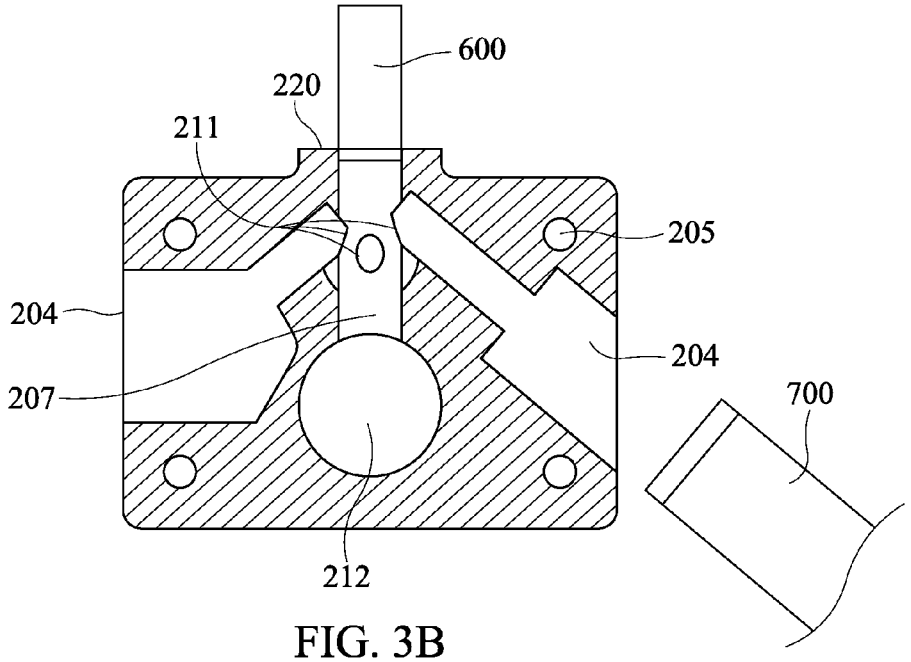
FIG. 3*b* illustrates a sectional view of the fuel flow assembly taken through lines 3*a*-3*a* in FIG. 1*b*.

In an exemplary embodiment, as illustrated in FIG. 3B, a plurality of inlet ports 204 extend to a common passage 207 which leads to the fuel outlet 212. The fuel outlet 209 can be formed in a front wall 210. In FIG. 3B, an inlet port 204 having a different configuration is formed on each of the side walls 202 and the rear wall 203. In the exemplary embodiment illustrated in FIG. 3B, the inlet ports 204 reduce in diameter, and are connected by holes 211 to the common passage 207.

Figure 4:
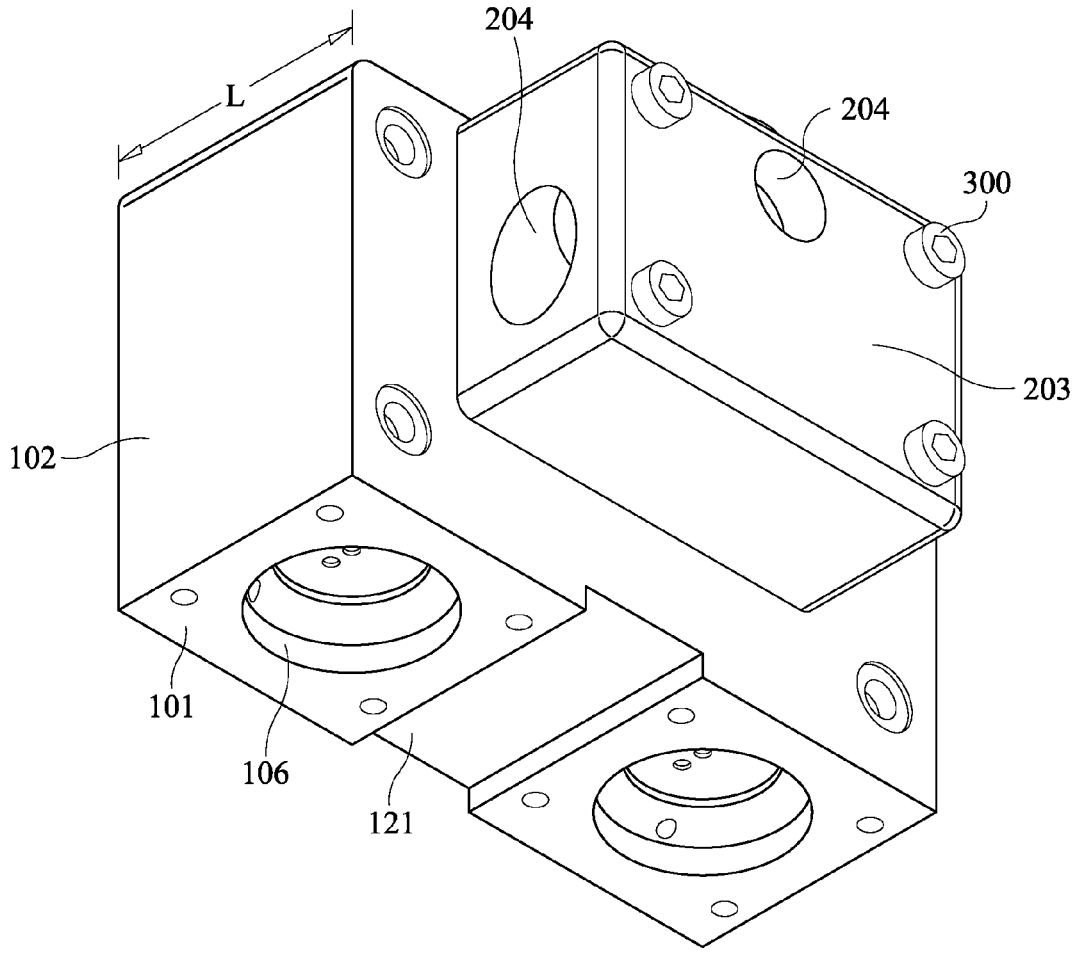
FIG. 4 is a perspective view of an assembled fuel flow assembly and fuel container.

FIG. 4 illustrates an assembled fuel container 100 and fuel flow assembly 200 according to an exemplary embodiment of the invention.

Figure 5:
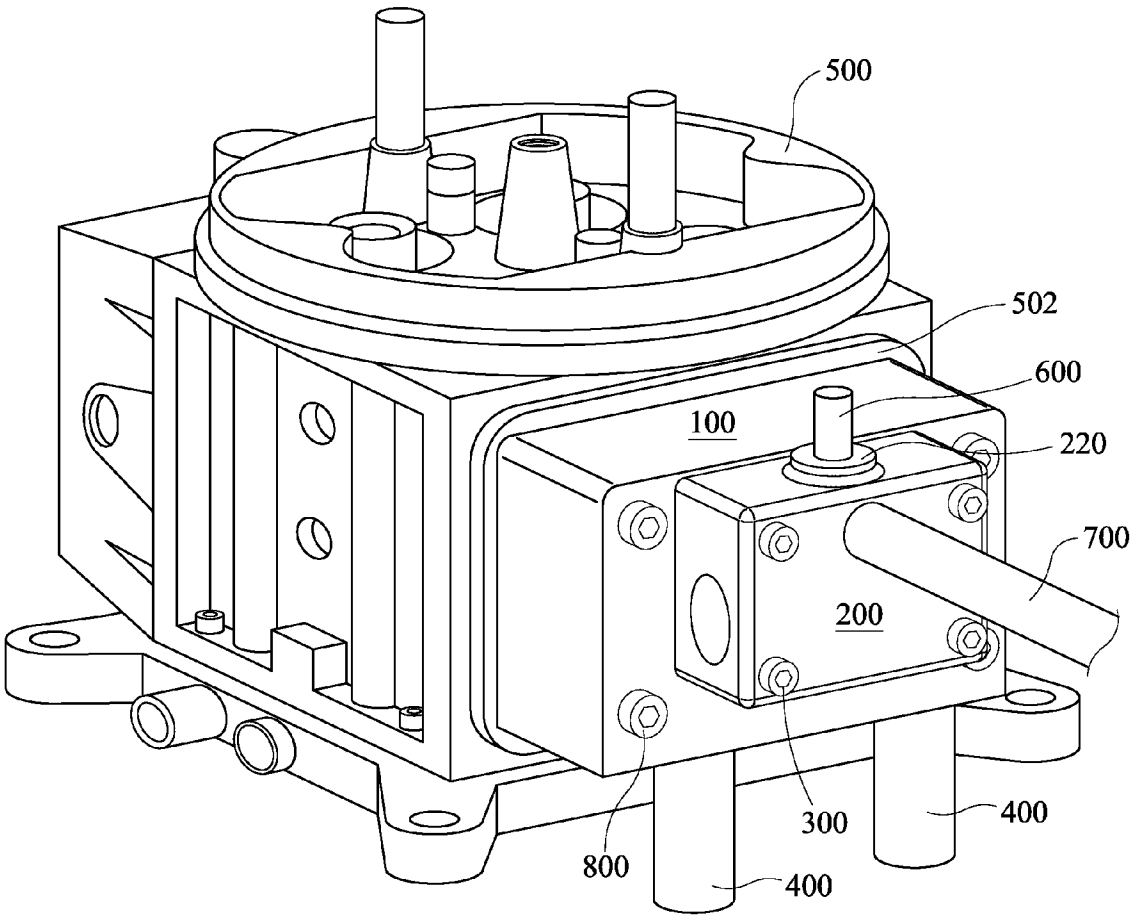
FIG. 5 is a perspective view showing the fuel flow assembly, the fuel container and the mounting portion of the carburetor main body.

FIG. 5, illustrates the fuel flow assembly 200 and fuel container 100 in relation to the carburetor main body mounting location 502.

While the invention has been described in terms of exemplary embodiments, those skilled in the art will recognize that the invention can be practiced with modification within the spirit and scope of the appended claims.

Further, it is noted that, Applicant's intent is to encompass equivalents of all claim elements, even if amended later during prosecution.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A fuel bowl for a carburetor system comprising:

a fuel container comprising:

a base, a pair of sidewalls extending upwardly from the base, a rear wall extending upwardly from the base, a top overlying the pair of sidewalls and the rear wall, and a cavity defined by the pair of sidewalls and the rear wall, wherein the base has a pair of pump housings formed therein, and wherein each of the pair of pump housings includes at least one passageway formed therethrough to provide access to the cavity, wherein the rear wall includes a fluid flow assembly passageway formed therethrough, and a plurality of carburetor fastener passageways formed therethrough, and a fuel flow assembly removeably coupled to the fuel container, the fuel flow assembly comprising:

a base, a pair of sidewalls extending upwardly from the base, a rear wall extending upwardly from the base, and a top overlying the pair of sidewalls and the rear wall, wherein a plurality of fuel inlet passageways are formed in at least one of the sidewalls and the rear wall, and wherein a plurality of fuel flow assembly fastener passageways are formed in the rear wall.

2. The fuel bowl according to claim 1 wherein the plurality of fuel inlet passageways includes a first fuel inlet passageway formed in a first one of the pair of sidewalls, a second fuel inlet passageway formed in a second one of the pair of sidewalls, and a third fuel inlet passageway formed in the rear wall.

3. The fuel bowl according to claim 2 wherein the first, second and third fuel inlet passageways are threaded.

4. The fuel bowl according to claim 3 wherein the threading of each of the first, second and third fuel inlet passageways are oriented differently from one another.

5. The fuel bowl according to claim 1 wherein each of the plurality of fuel flow assembly fastener passageways formed in the rear wall of the fuel flow assembly includes a recess adapted to receive a gasket.

6. The fuel bowl according to claim 1 wherein the fuel flow fastener assembly passageway formed in the rear wall of the fuel container includes a gasket recess formed therein adapted to receive a gasket.

7. The fuel bowl according to claim 1 wherein each of the plurality of carburetor fastener passageways formed in the rear wall of the fuel container includes a recess adapted to receive a gasket.

8. The fuel bowl according to claim 1 wherein the fuel flow assembly fastener passageways formed in the rear wall of the fuel flow assembly are adapted to be aligned with the fuel flow assembly fastener passageways formed in the rear wall of the fuel container when the fuel flow assembly is connected to the fuel container.

9. The fuel bowl according to claim 1 wherein the base of the fuel container includes a recess extending substantially the length thereof and positioned between each of the pair of pump housings.

10. A fuel bowl for a carburetor system comprising:

a fuel container comprising:

a base, a pair of sidewalls extending upwardly from the base, a rear wall extending upwardly from the base, a top overlying the pair of sidewalls and the rear wall, and a cavity defined by the pair of sidewalls and the rear wall, wherein the base has a pair of pump housings formed therein, and wherein each of the pair of pump housings includes at least one passageway formed therethrough to provide access to the cavity, wherein the rear wall includes a fluid flow assembly passageway formed therethrough, and a plurality of carburetor fastener passageways formed therethrough, and a fuel flow assembly removeably coupled to the fuel container, the fuel flow assembly comprising:

a base, a pair of sidewalls extending upwardly from the base, a rear wall extending upwardly from the base, a top overlying the pair of sidewalls and the rear wall, a first fuel inlet passageway formed in a first one of the pair of sidewalls, a second fuel inlet passageway formed in a second one of the pair of sidewalls, and a third fuel inlet passageway formed in the rear wall, wherein the first, second and third fuel inlet passageways are threaded, wherein the threading of each of the first, second and third fuel inlet passageways are oriented differently from one another, wherein a plurality of fuel flow assembly fastener passageways are formed in the rear wall, and wherein the fuel flow assembly fastener passageways formed in the rear wall of the fuel flow assembly are adapted to be aligned with the fuel flow assembly fastener passageways formed in the rear wall of the fuel container when the fuel flow assembly is connected to the fuel container.

11. The fuel bowl according to claim 10 wherein each of the plurality of fuel flow assembly fastener passageways formed in the rear wall of the fuel flow assembly includes a recess adapted to receive a gasket.

12. The fuel bowl according to claim 10 wherein the fuel flow fastener assembly passageway formed in the rear wall of the fuel container includes a gasket recess formed therein adapted to receive a gasket.

13. The fuel bowl according to claim 10 wherein each of the plurality of carburetor fastener passageways formed in the rear wall of the fuel container includes a recess adapted to receive a gasket.

14. The fuel bowl according to claim 10 wherein the base of the fuel container includes a recess extending substantially the length thereof and positioned between each of the pair of pump housings.

15. A method of connecting a fuel bowl to a carburetor, the fuel bowl comprising a fuel container and a fuel flow assembly that is removeably couplable to the fuel container, the fuel container comprising a base, a pair of sidewalls extending upwardly from the base, a rear wall extending upwardly from the base, a top overlying the pair of sidewalls and the rear wall, and a cavity defined by the pair of sidewalls and the rear wall, the fuel flow assembly comprising a base, a pair of sidewalls extending upwardly from the base, a rear wall extending upwardly from the base, a top overlying the pair of sidewalls and the rear wall, the method comprising:

connecting the fuel container to the carburetor by passing carburetor fasteners through carburetor fastener passageways formed in the rear wall of the fuel container to engage a portion of the carburetor to which the fuel container is to be connected; and connecting the fuel flow assembly to the fuel container by aligning fuel flow assembly fastener passageways formed through the rear wall of the fuel container with fuel flow assembly fastener passageways formed through the rear wall of the fuel flow assembly, and passing a fuel flow assembly fastener through each of the fuel flow assembly fastener passageways formed in the rear wall of the fuel flow assembly through the rear wall of the fuel container.

16. The method according to claim 15 wherein the base of the fuel container has one or more pump housing formed therein, and wherein the pump housing includes at least one passageway formed therethrough to provide access to the cavity.

17. The method according to claim 15 wherein a plurality of fuel inlet passageways are formed in at least one of the sidewalls and the rear wall of the fuel flow assembly; wherein the plurality of fuel inlet passageways includes a first fuel inlet passageway formed in a first one of the pair of sidewalls, a second fuel inlet passageway formed in a second one of the pair of sidewalls, and a third fuel inlet passageway formed in the rear wall; wherein the first, second and third fuel inlet passageways are threaded; and wherein the threading of each of the first, second and third fuel inlet passageways are oriented differently from one another.

18. The method according to claim 15 further comprising positioning a gasket in a recess formed on each of the plurality of fuel flow assembly fastener passageways formed in the rear wall of the fuel flow assembly prior to passing the fuel flow assembly fastener therethrough; and positioning a gasket in a recess formed in each one of the plurality of carburetor fastener passageways prior to passing the carburetor fastener therethrough.

19. The method according to claim 15 further comprising positioning a gasket in a recess formed on the fluid flow assembly passageway prior to connecting the fuel flow assembly to the fuel container.

20. The method according to claim 15 wherein the fuel container is coupled to the carburetor prior to mounting the fuel flow assembly to the fuel container; and wherein the fuel flow assembly is adapted to be removable from the fuel container without the fuel container being removed from the carburetor.

* * * * *